US007947152B2

(12) United States Patent
Amonarriz Azcolain et al.

(10) Patent No.: US 7,947,152 B2
(45) Date of Patent: May 24, 2011

(54) DOCTOR BLADE FOR THE PAPER INDUSTRY

(76) Inventors: Jose Joaquin Amonarriz Azcolain, Tolosa (ES); Jose Miguel Echeberria Giocoechea, Tolosa (ES)

( * ) Notice: Subject to any disclaimer, the term of this patent is extended or adjusted under 35 U.S.C. 154(b) by 79 days.

(21) Appl. No.: 12/599,801

(22) PCT Filed: Feb. 27, 2008

(86) PCT No.: PCT/ES2008/000113

§ 371 (c)(1),
(2), (4) Date: Nov. 11, 2009

(87) PCT Pub. No.: WO2009/013364

PCT Pub. Date: Jan. 29, 2009

(65) Prior Publication Data

US 2010/0300638 A1 Dec. 2, 2010

(30) Foreign Application Priority Data

Jul. 24, 2007 (ES) ..... 200702059

(51) Int. Cl.
*D21G 3/00* (2006.01)

(52) U.S. Cl. ..... 162/281; 162/198; 162/263; 162/272; 15/256.51; 15/256.52; 118/119; 118/126; 118/413

(58) Field of Classification Search ..... 162/111, 162/198, 263, 272, 281; 15/256.51, 256.52; 118/119, 126, 413
See application file for complete search history.

(56) References Cited

U.S. PATENT DOCUMENTS

| | | | | |
|---|---|---|---|---|
| 3,087,184 | A | 4/1963 | Ljungquist | |
| 6,328,853 | B1 * | 12/2001 | Goodnow et al. | 162/281 |
| 6,547,932 | B1 * | 4/2003 | Leinonen et al. | 162/281 |
| 7,217,341 | B2 * | 5/2007 | Luoma et al. | 162/272 |
| 2005/0121164 | A1 * | 6/2005 | Luoma et al. | 162/281 |

FOREIGN PATENT DOCUMENTS

| | | | |
|---|---|---|---|
| ES | 2219303 | A | 10/2001 |
| GB | 2160613 | A | 12/1985 |
| WO | 2004005614 | A | 1/2004 |
| WO | 2004005615 | A | 1/2004 |

* cited by examiner

*Primary Examiner* — Eric Hug
*Assistant Examiner* — Peter Chin
(74) *Attorney, Agent, or Firm* — Lucas & Mercanti, LLP

(57) ABSTRACT

Doctor blade for the paper industry, comprising a scraping plate (1) and holding means (p) for the scraping plate which in turn are held by a frame (a) the ends of which are securely fastened (2) by two fastening points (pf) to a stationary structure (f), characterized in that it comprises: a) mechanical means for adjustable fastening (3) between at least one end (2) of the frame and the stationary structure (f) in such a way that the distance (d) between the two fastening points (pf) can be varied by the user; and b) means for incorporating an additional mass (5) in adjustable quantities.

6 Claims, 11 Drawing Sheets

DOCTOR BLADE FOR THE PAPER INDUSTRY

CROSS REFERENCE TO RELATED APPLICATIONS

This application is a 371 of PCT/ES2008/000113 filed Feb. 27, 2008, which in turn claims the priority of ES P200702059 filed Jul. 24, 2007, the priority of both applications is hereby claimed and both applications are incorporated by reference herein.

In the paper industry, doctors or scrapers are used, with their scraping blade in contact with the corresponding paper-conducting cylinder.

The needs for industrial profitability require the turning speed of the paper-conducting cylinder to be increased substantially over time, but this increase in speed seriously disturbs the behaviour of the doctor.

The applicant has studied said disturbances and has found that the cause is the vibrations of the doctor itself with the increase of the speed of the paper-conducting cylinder.

The doctor enters vibration because its natural frequency coincides with the natural frequency or some of the main turning harmonics of the paper-conducting cylinders.

Given that, if the speed of the paper-conducting cylinder increases, the excitation frequencies increase, the applicant has deduced that it is necessary to increase the natural frequency of the doctor to always keep it above any excitation frequency in the paper machine.

In his tests, the applicant has discovered that the natural frequency of the doctor (H) is governed approximately by the following function: $H=f(1/d^2)$, (d) being the distance between supports of the doctor unit.

Until now, the supports of the doctor were made to be permanently on a fixed structure, so that the distance between the fastening points was fixed; thus, on increasing the speed of the paper-conducting cylinder, the doctor began to vibrate.

The applicant has developed a doctor in which the distance between supports/fastening points is variable/adjustable at will; thus, the economic life of the doctor is extended in time, the doctor adapting to the speeds of the paper-conducting cylinder which the user, the economy and the industrialist require.

The applicant has also discovered in this tests that the natural frequency of the doctor is influenced by the mass of the framework, the way of joining said mass to the framework and that the vibrations generated can be diminished by the addition of damping elements or the addition of controlled excitations; thus, the doctor of the application is also characterized because:

- The framework consists of means to incorporate an additional mass in adjustable quantity;
- it consists of means to adjust the position of the additional mass on the framework;
- it consists of means to adjust the rigidity of the coupling between the additional mass and the framework; and
- the coupling between the additional mass and the framework consists of a damping element.
- it consists of active means which introduce excitations, depending on the vibrations, accelerations and/or deformations measured.

To better understand the purpose of this invention, a preferential way of practical embodiment is shown on the diagrams, subject to supplementary changes which do not fundamentally alter them.

Figure 4A:
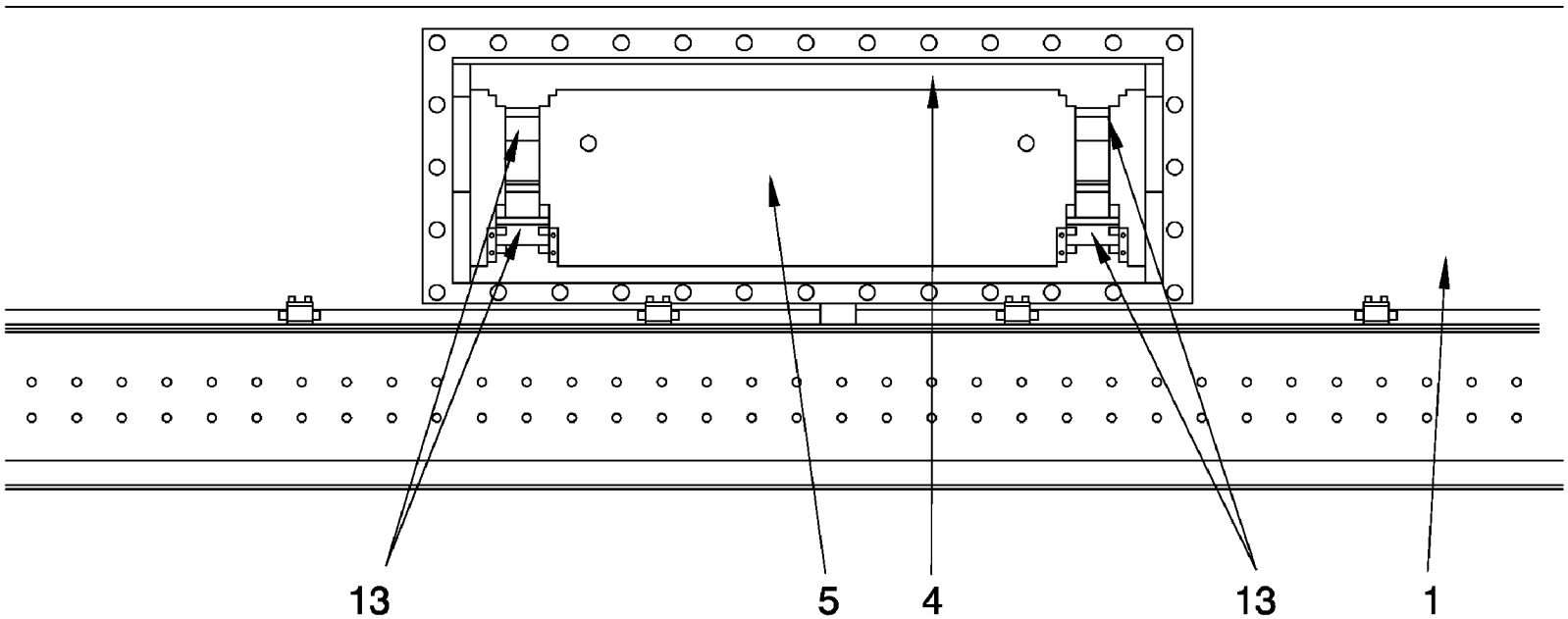
Figure 4B:
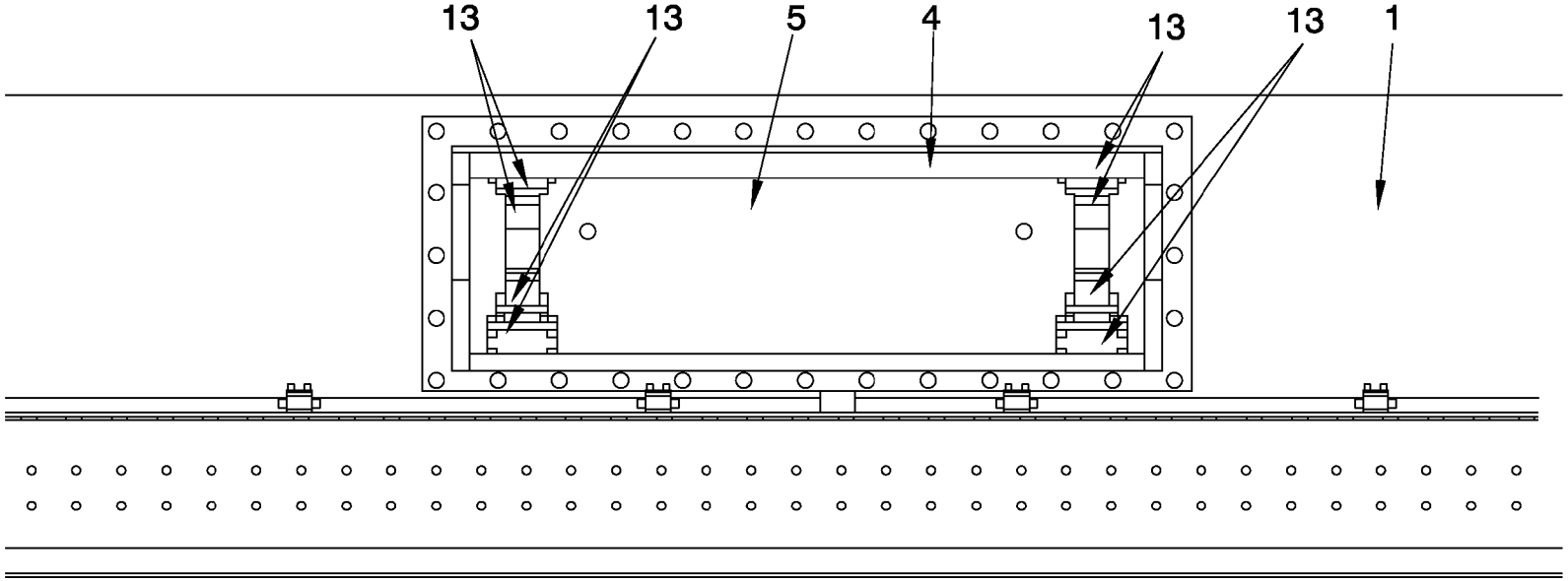

FIGS. 4*a* and 4*b* show the mass (5) joined to the framework with a flexible coupling (13).

In FIG. 4*b*, in addition to the interior bands (13), the exterior bands (13) have been installed so as to increase the rigidity of the coupling.

Figure 5:
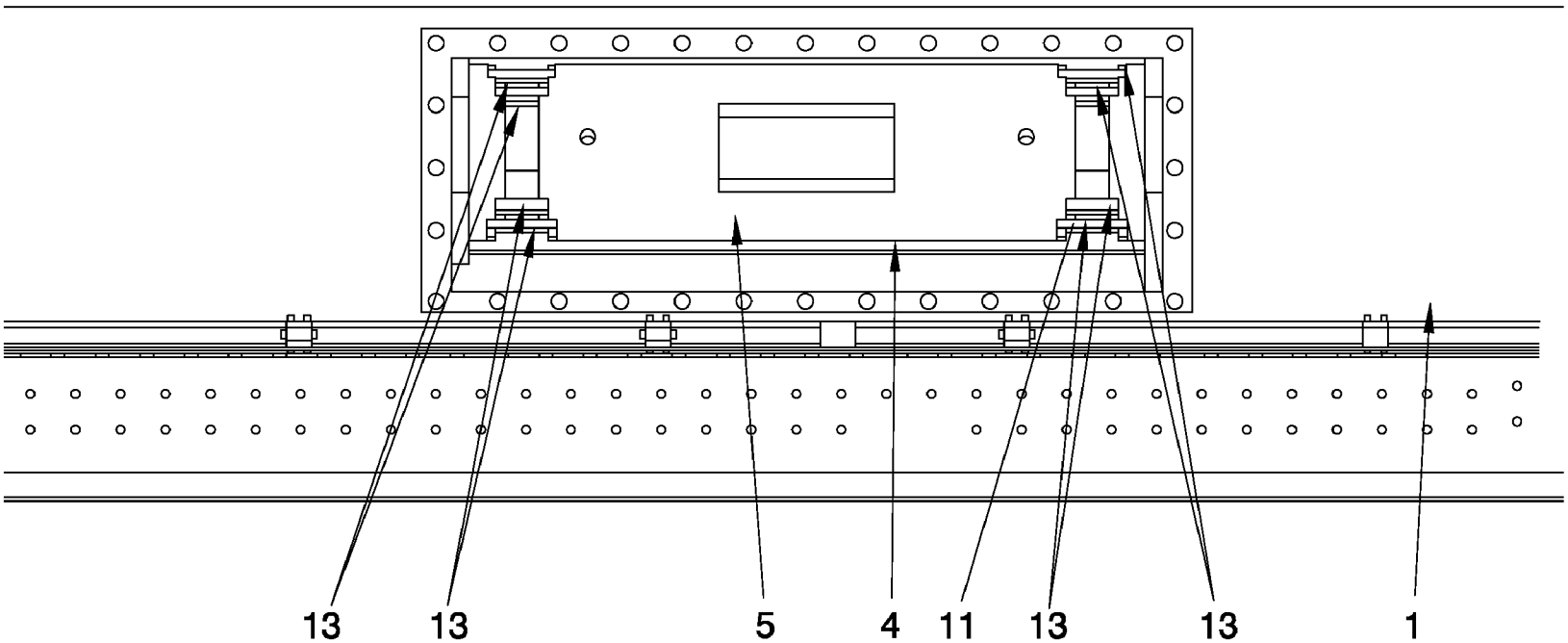

FIG. 5 shows the same structural configuration of FIG. 4, but with a mass (5) of lower value.

Figure 6:
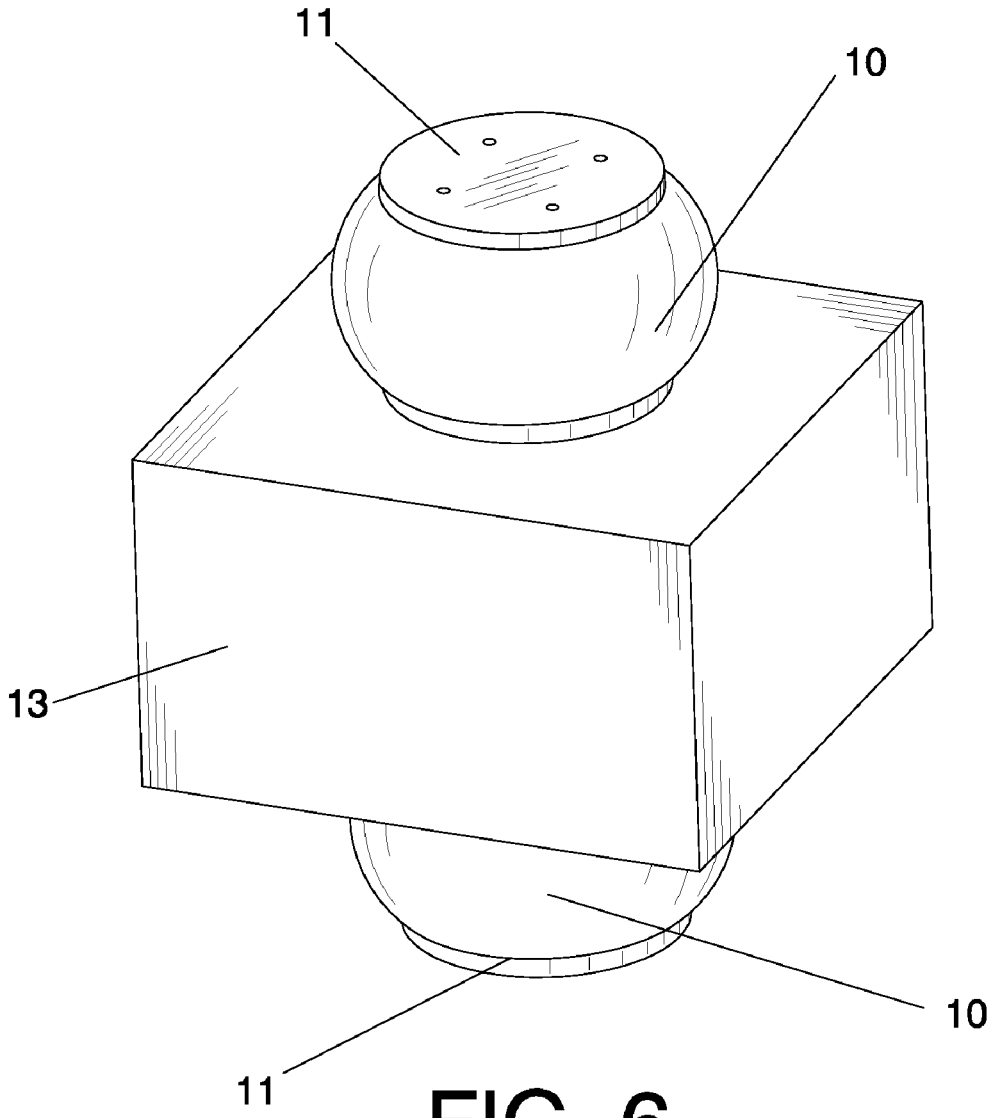

FIG. 6 shows an example of embodiment which makes use of pneumatic balloons (10) to support a mass (5).

Figure 7:
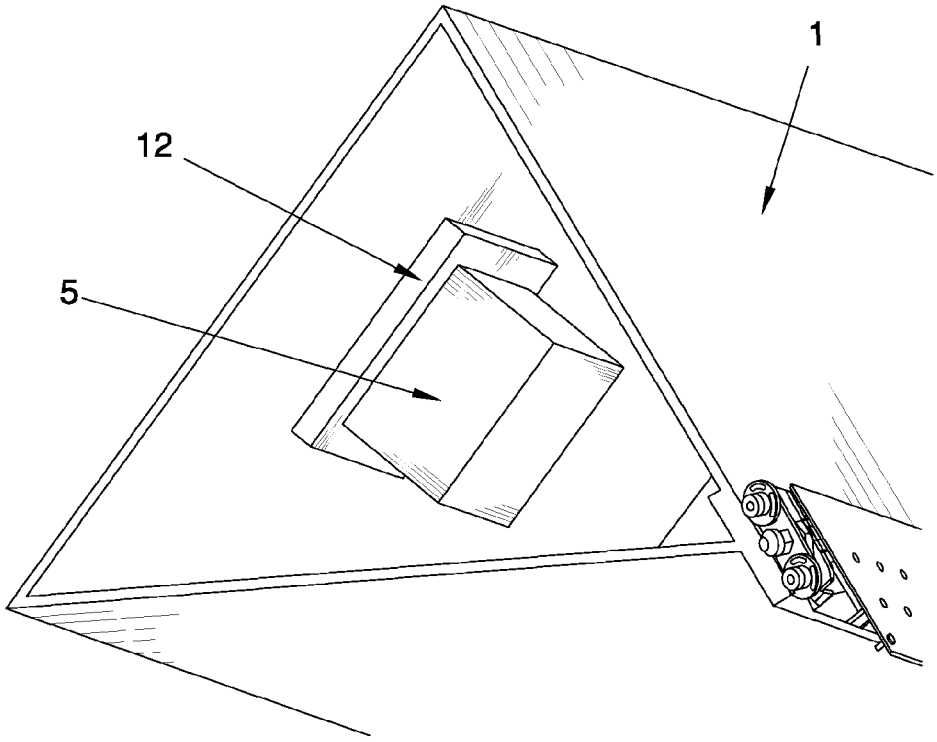

FIG. 7 shows another example of embodiment, in which the mass (5) is joined to the framework (1) with a damping material (12) between both elements.

Figure 8:
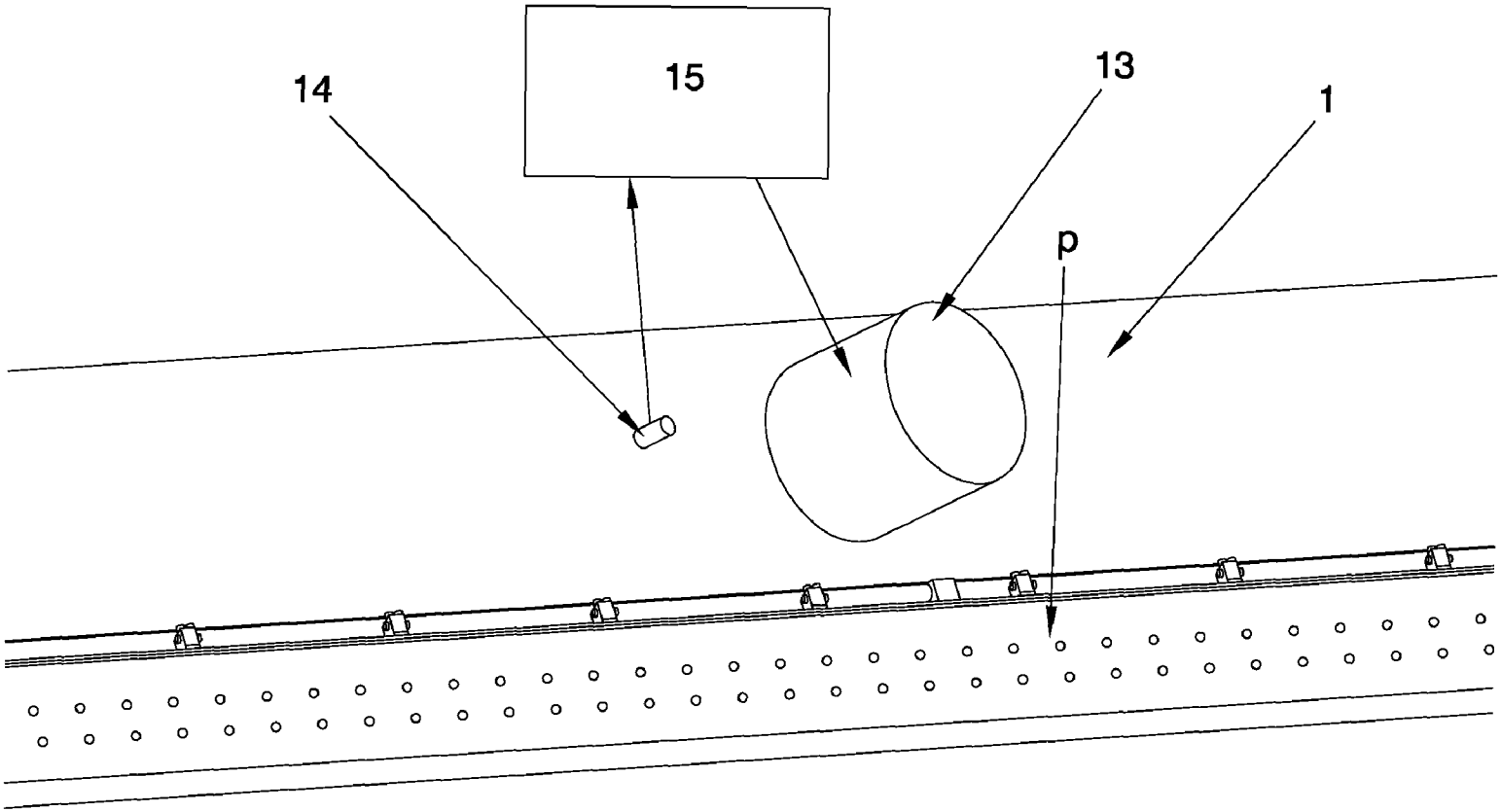

FIG. 8 shows an example of embodiment in which an exciter or actuator (13) has been coupled to the framework (1), in which vibrations, accelerations and or displacements are measured with a sensor (14). Moreover, the system consists of a controller which makes the actuator or exciter act according to the readings acquired in the sensor.

An example of practical, non-limiting embodiment of this invention is described below.

Figure 1A:
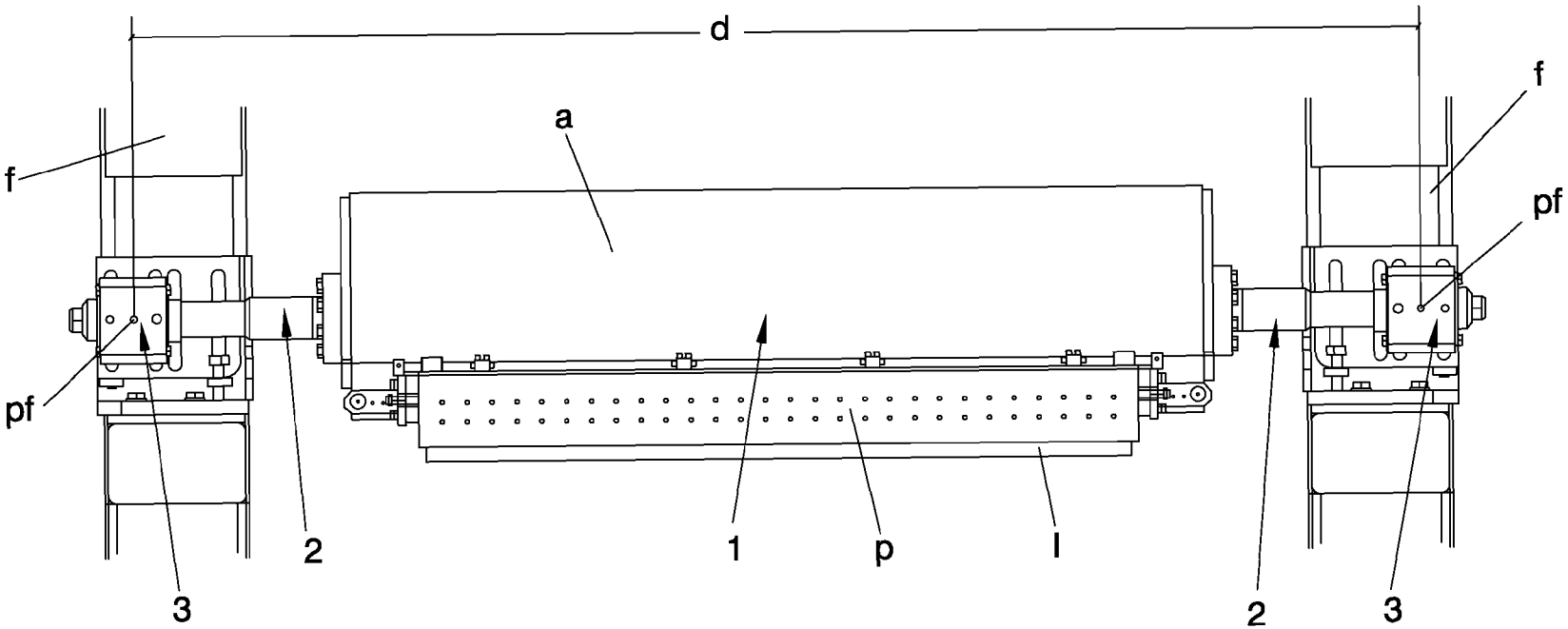
In FIG. 1*a* the supports of the doctor (3) have been fastened to the fixed structure, distanced (d) as far to the exterior as possible, while in FIG. 1*b* they have been placed as far inside as possible.
Figure 1B:
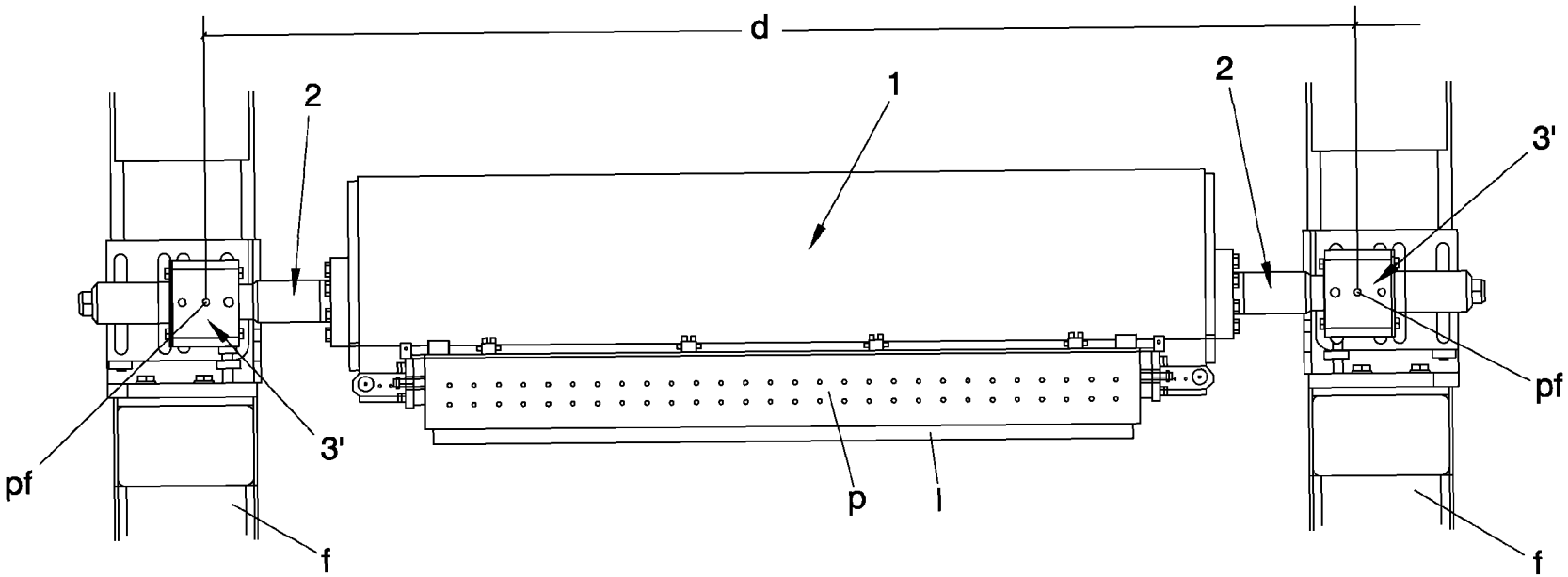
FIG. 1 shows an example of how the distance can be modified between supports on a doctor according to the invention.
Figure 2A:
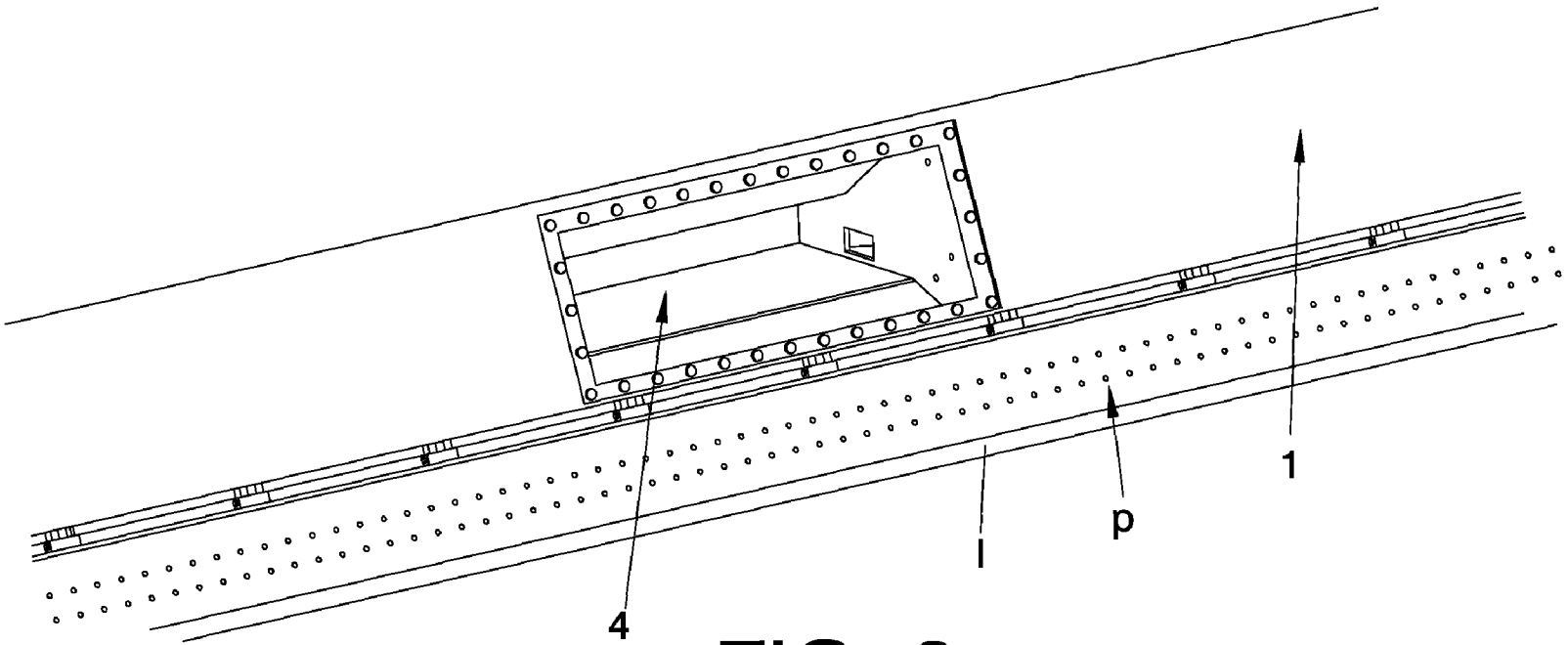
FIG. 2 shows a framework (1) similar to that of FIG. 1, with the difference that in this case an opening has been made (4) -FIG. 2*a*- in order to fasten to that opening (4) a mass (5) -FIG. 2*b*-.
Figure 2B:
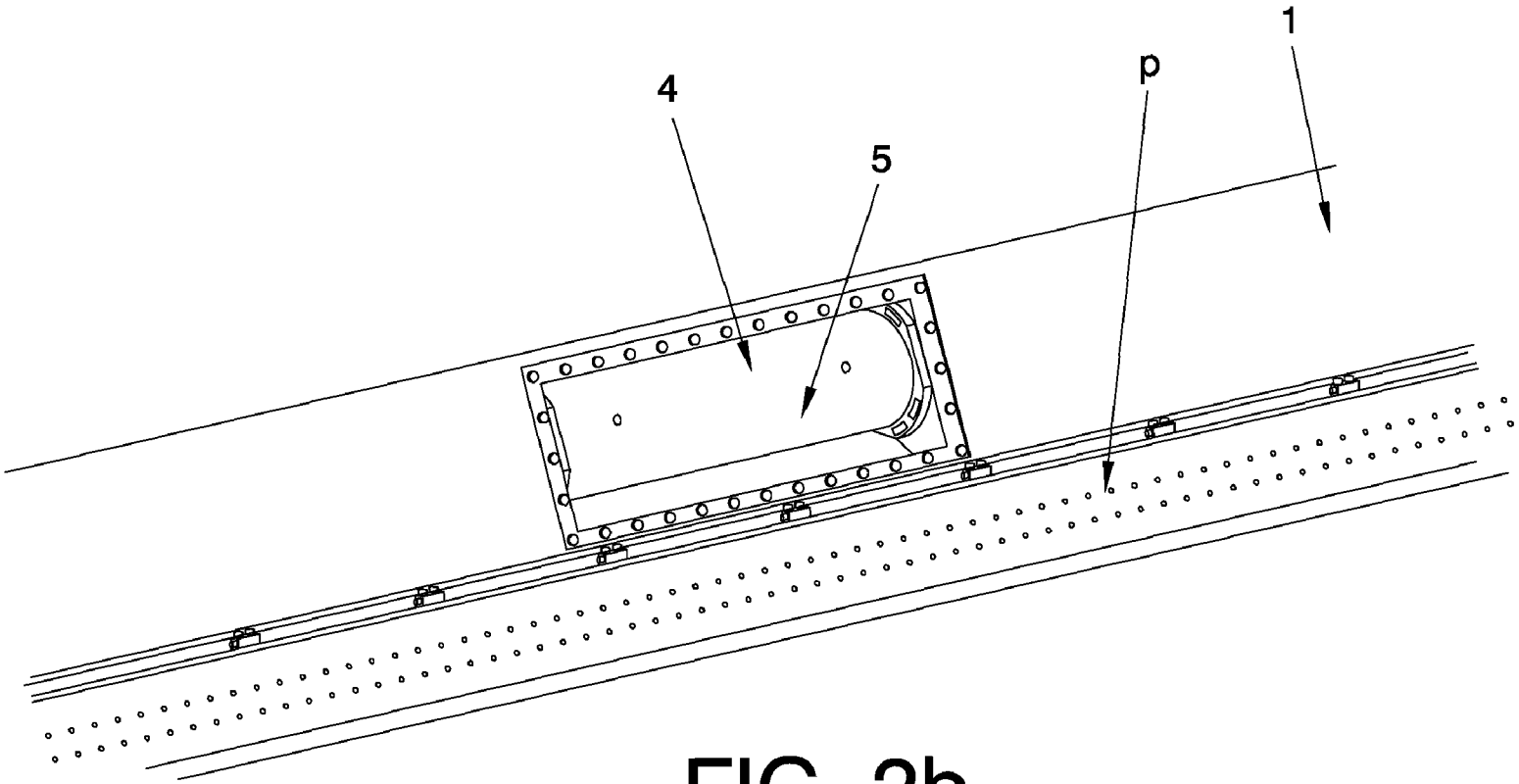

The doctor for the paper industry, according to the invention and as seen in FIGS. 1*a* and 1*b*, is of the type that consists of a scraping blade (l), of means for holding (p) the scraping blade (l) which, in turn, are supported by a frame (a) which fastens its ends (2) by two fastening points (pf) to a fixed structure (f).

In accordance with the invention, the doctor blade for the paper industry consists of mechanical means of adjustable fastening (3) between, at least, one end (2) of the frame and the fixed structure (f) so that the distance (d) between the two fastening points (pf) can be varied at the will of the user.

Shown in FIGS. 1*a* and 1*b* are the supports (3), (3') of the doctor in two possible extreme positions possible for this example of embodiment.

In addition, rigidly fastening a mass (5) in a position of the frame (1) allows modification of its dynamic behaviour, so that according to the speed of the paper to be utilized, it is decided whether to fasten the mass (5) or not. In general, the natural frequency will decrease when the mass (5) goes into the frame (1).

The frames (1) of the doctors are hollow structures; this allows mass (5) to be inserted inside them. In some cases, said mass (5) may also be fastened on the exterior, as long as the space available for the frame (1) in the paper machine so allows.

In FIGS. 2 to 7 below, different examples of embodiment are shown with various positions of the mass (5) the frame (1).

In the example of embodiment of doctor with mass (5) fastened whose position may be adjusted, the dynamic behaviour of the frame structure (1) can be modified by moving said mass (5) inside the frame (1). The dynamic behaviour of the structure can be adjusted even when the paper machine is in operation.

Figure 3:
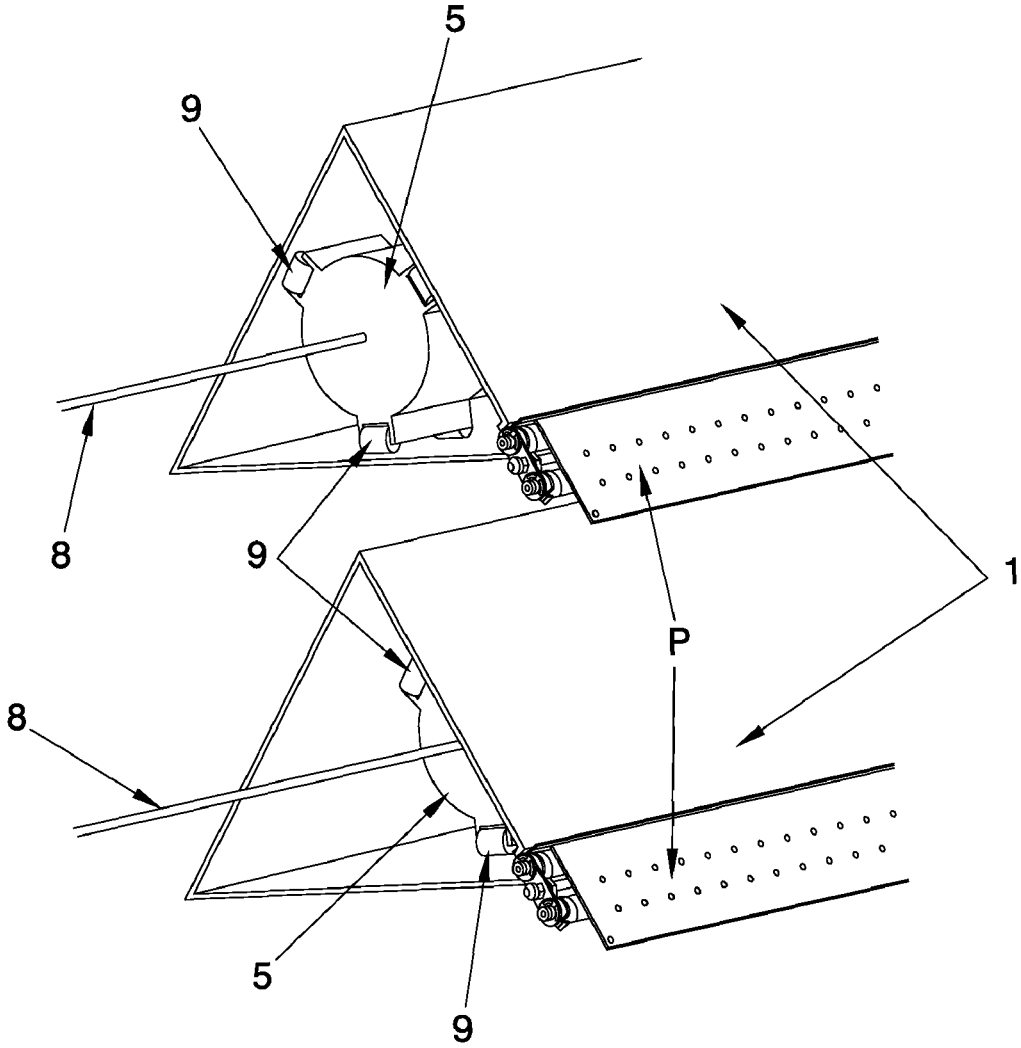
FIG. 3 shows a framework (1) with a mass (5) inside it, and with an adjustable axial position.

A mass (5) which is adjustable in position can be made in many ways:

In the example of embodiment of FIG. 3 a frame (1) is shown in which a mass (5) has been inserted into the hollow space inside. The contact between the mass (5) and the frame (1) is made with a guide (9). The axial position of the mass (5) can be controlled with an activating mechanism (8); in the case of FIG. 3, this activation is carried out with a cable.

In the example of embodiment of FIGS. 4*a*, 4*b* the doctor is shown with mass (5) flexibly fastened. By the modification of the value of the mass (5) or of the flexibility of the coupling made we can modify the dynamic behaviour of the structure.

A solution in which it is necessary to stop the machine to modify the behaviour consists of inserting into the frame (1), in which an opening has been made, the device with the controlled mass (5) and with a coupling controlled in rigidity.

We can provide solutions in which it is necessary to stop the machine to modify the behaviour or we have more complicated solutions which allow the modification of the dynamic behaviour with the machine in operation.

FIG. 4 shows a way of joining the mass (5) to the structure of the frame (1) controlling the rigidity of this coupling. The coupling of the upper part and the coupling of the lower part has a different rigidity, and therefore, the dynamic behaviour of the system will be different. This configuration allows the realization of a frame (1) with a multitude of dynamic behaviours, as it can be assembled:

a) Without mass (5).

b) With the mass (5) connected with four bands (13).

c) With the mass (5) connected with eight bands (13).

d) Realizing the assembly of the mass (5) with bands (13) of different thicknesses.

In addition to including the modification of the rigidity, the modification of the mass (5) is also included. For example, an assembly could be made with the lower part of FIG. 4 and subsequently assembly with a mass (5) of less value could be realized. For example, a mass (5) with the same geometrical shape but perforated, as shown in FIG. 5.

Shown in FIG. 6 is another way of making a flexible support, consisting of using pneumatic balloons (10) which support a mass (5). The two pneumatic balloons (10) of FIG. 6 are fastened to a mass (5), and the free side (11) of the balloons (10) are fastened to the frame (1) of the doctor. The rigidity with which the mass (11) is joined to the frame (1) depends on the pneumatic pressure to which the pneumatic balloons (10) are subjected. The controlled modification of the pressure by a pneumatic cabinet allows us, therefore, to modify the dynamic behaviour of the frame (1), and therefore, it is not necessary for the machine to be stopped to modify the dynamic behaviour of the system.

Another solution, shown in FIG. 7, consists of fastening against the frame (1) a mass (5) installing between the two a damping material (12).

Through the use of a flexibly fastened mass with a damping element (12) (such as elastomeres, viton, etc.), the amplitude of the vibrations is diminished. In, for example, the embodiment shown in FIG. 4, if the material of the band (13) is a material with a high degree of damping, as well as modifying the value of the natural frequency, the amplitude of the vibration which the doctor is to be subjected to is diminished.

FIG. 8 shows another solution in which an exciter (13) is used fastened on the frame (1). One or several sensors (14) and a controller (15) are added to the system.

The introduction of forces upon the frame depending on the procedure carried out allows the reduction or cancellation of dynamic problems which may exist in the system.

The invention claimed is:

1. Doctor for the paper industry, comprising: a scraping blade; means for holding the scraping blade which in turn are supported by a frame which fastens its ends by two fastening points to a fixed structure; and a mechanical means of adjustable fastening between at least one end of the frame and the fixed structure so that the distance between the two fastening points can be varied at the will of the user.

2. Doctor of claim 1, wherein the frame has a means for incorporating an additional mass in adjustable quantity.

3. Doctor of claim 2, further comprising a means for adjusting the position of the additional mass in the frame.

4. Doctor of claim 2, further comprising a coupling between the additional mass and frame and means for regulating rigidity of the coupling between the additional mass and the frame.

5. Doctor of claim 2, wherein the coupling between the additional mass and the frame has a damping element.

6. Doctor of claim 1, further comprising an exciter, a sensor and a controller in operative connection to the doctor for damping vibrations.

* * * * *